US005418109A

United States Patent [19]

Kanakura et al.

[11] Patent Number: 5,418,109

[45] Date of Patent: May 23, 1995

[54] PRODUCTION OF TONER

[75] Inventors: Akihiro Kanakura, Hirakata; Yutaka Harada, Suita; Takehiro Ojima, Habikino; Shinji Seo, Neyagawa; Haruhiko Sato, Yawata, all of Japan

[73] Assignee: Nippon Paint Company, Osaka, Japan

[21] Appl. No.: 233,446

[22] Filed: Apr. 26, 1994

[30] Foreign Application Priority Data

Apr. 28, 1993 [JP] Japan ..... 5-102338

[51] Int. Cl.[6] ..... G03G 9/093; G03G 9/097

[52] U.S. Cl. ..... 430/137; 430/138

[58] Field of Search ..... 430/137, 138

[56] References Cited

U.S. PATENT DOCUMENTS 5,190,844 3/1993 Yabuchi et al. ..... 430/137

FOREIGN PATENT DOCUMENTS 129757 7/1985 Japan ..... 430/137

WO87/0182 3/1987 WIPO .

OTHER PUBLICATIONS

Hitachi International KK, Derwent Abstract of JP-1093748, "Preparation of Toner for Electrophotography", 1989.

Dainippon Ink & Chemical, Inc., Abstract of JP-01302269, "Method for Manufacturing Electrostatic Charge Image Developing Toner", Dec. 6, 1989.

Toyo Ink Mfg Co Ltd, Abstract of JP-01144061, "Electrostatic Toner", Jun. 6, 1989.

*Primary Examiner*—Roland Martin

*Attorney, Agent, or Firm*—Wenderoth, Lind & Ponack

[57] ABSTRACT

Disclosed is a preparation method of a toner comprising steps of:

(a) preparing a dispersion mixture containing colored polymer particles, a charge controlling agent and organic resin fine particles, in an aqueous medium;

(b) allowing said charge controlling agent and organic resin fine particles to be adhered on the surface of said colored polymer particles by salting-out;

(c) drying said colored polymer particles having thereon said charge controlling agent and organic resin fine particles; and (d) applying mechanical impact to said colored polymer particles to effect a conversion of said organic resin fine particles into a film on the surfaces of said colored polymer particles.

5 Claims, 1 Drawing Sheet

PRODUCTION OF TONER

FIELD OF THE INVENTION

The present invention relates to an electrophotographic toner applicable in the fields of, for example, electrophotography and electrostatic record.

BACKGROUND OF THE INVENTION

A preparation of toner for developing electrostatic images has been conventionally carried out in such a manner that: a coloring agent like dyestuff and pigment and optionally by a magnetic material, a charge controlling agent and an offset prohibitor are added to a molten thermoplastic resin, and mixed well and the mixture is cooled to solidify, followed by pulverization and classification.

The conventional method, however, has been confronting with troubles such as a multiplicity of steps and apparatuses, complex process and difficulty in producing toner of small grain sizes. Further it has a drawback that the produced powder has not only a wide grain distribution but also non-uniform shapes so that the material has a poor fluidity, resulting in fog of an image.

To prepare toner with a uniform grain shape, a small grain size and a narrower grain distribution, various polymerization processes have been proposed. For example, Japanese Patent Publication Nos. Sho 47-518305 and Sho 51-14895 disclose a method by a suspension polymerization, Japanese Patent Laid-Open No. Sho 63-282749 by an emulsion polymerization and Japanese Patent Laid-Open No. Hei 3-200976 by a dispersion polymerization.

However, the toners produced by such polymerization methods irresistibly contain a dispersing agent which is used in the polymerization process. Thus the toners prepared by polymerization methods are in general sensitive to humidity, which is likely to deteriorate charge properties and fluidity. Moreover, there still exist problems that; kinds and amounts of applicable charge controlling agent are so restricted as not to prevent polymerization reaction; electrified quantities may fluctuate among the toner particles due to inhomogeneous dispersion state of the charge controlling agent; and the charge controlling agent is present within the toner particles, which do not contribute to friction electrification, leading to an insufficient utilization of the charge controlling agent.

Various attempts have been done to improve the charge properties of toner produced by polymerization methods. For example, Japanese Patent Laid-Open Nos. Sho 62-226162 and Sho 64-59239 disclose a toner preparation method, wherein organic resin fine particles are adhered to surfaces of colored polymer particles. But in adhesion of organic resin fine particles to the surfaces of the colored polymer particles through an electrostatic interaction, the surface charges of both organic resin fine particles and colored polymer particles must be controlled so that kinds of applicable materials will be limited and amounts of the organic resin fine particles to be adhered will be insufficient. Also in the method wherein organic resin fine particles and colored polymer particles are dried separately and then the surface adherence is conducted by mechanical blend, the cohesives are apt to be yielded at the time of particle drying so that it is difficult to adhere to the surfaces in the form of primary particles.

Japanese Patent Laid-Open Nos. Hei 4-67155 and Hei 4-213464 disclose a preparation method wherein a charge controlling agent is adhered or settled to the surfaces of colored polymer particles through an insolubilization, etc. This method is effective in utilizing the charge controlling agent but on the other hand the adherence of the conditioner is insufficient and as a result the charge controlling agent removes readily from the surfaces of the colored polymer particles leading to a charging hindrance in actual service.

There is also described a method in Japanese Patent Laid-Open No. Hei 1-93748 that agglomerates of organic resin fine particles are formed by salting-out and after drying, coloring agents etc. are adhered thereon by applying mechanical impact. This method, however, fails to assure charge stability.

SUMMARY OF THE INVENTION

The present invention is to solve the above stated problems and its principal object is to provide a preparation method of a toner having a stable charge properties under conditions of elevated temperatures and high humidity.

The present invention provides a preparation method of a toner comprising steps of:

(a) preparing a dispersion mixture containing colored polymer particles, a charge controlling agent and organic resin fine particles, in an aqueous medium;
(b) allowing the charge controlling agent and organic resin fine particles to be adhered on the surface of the colored polymer particles by salting-out;
(c) drying the colored polymer particles having thereon the charge controlling agent and organic resin fine particles; and
(d) applying mechanical impact to the colored polymer particles to effect a conversion of the organic resin fine particles into a film on the surfaces of the colored polymer particles.

The present invention also provide a preparation method of a toner comprising steps of:

(a) preparing a dispersion mixture containing colored polymer particles and a charge controlling agent in an aqueous medium;
(b) allowing the charge controlling agent to be adhered on the colored polymer particles by salting-out;
(c) containing organic resin fine particles in the dispersion mixture;
(d) allowing the organic resin fine particles to be adhered on the colored polymer particles by salting-out;
(e) drying the colored polymer particles having thereon the charge controlling agent and organic resin fine particles; and
(f) applying mechanical impact to the colored polymer particles to effect a conversion of the organic resin fine particles into a film on the surfaces of the colored polymer particles.

The present invention further provides a preparation method of a toner comprising steps of:

(a) preparing a dispersion mixture containing colored polymer particles and organic resin fine particles in an aqueous medium;
(b) allowing the organic resin fine particles to be adhered on the colored polymer particles by salting-out;
(c) containing a charge controlling agent in the dispersion mixture;

(d) allowing the charge controlling agent to be adhered on the colored polymer particles by salting-out;

(e) drying the colored polymer particles having thereon the charge controlling agent and organic resin fine particles; and (f) applying mechanical impact to the colored polymer particles to effect a conversion of the organic resin fine particles into a film on the surfaces of the colored polymer particles.

DETAILED DESCRIPTION OF THE INVENTION

The colored polymer particles used in the present invention can be produced by various methods known by those skilled in the arts. The methods involve, for example, a grinding method of melt-kneaded resin, and a polymerization process such as emulsion polymerization, dispersion polymerization, and suspension polymerization, etc. In view of the step of dispersing the resulting particles into an aqueous medium, the polymerization process is preferred. A suspension polymerization is the most advantageous in that the colored polymer particles having a particle size of 4 to 12 μm, which is very useful as a toner, can be produced easily.

Polymerizable monomers for preparing the colored polymer particle in the above mentioned polymerization methods, may be any that can be polymerized and include styrenes, such as styrene, p-chlorostyrene and p-methylstyrene; vinyl esters, such as vinyl acetate, vinyl propionate and vinyl benzoate; (meth)acrylates, such as methyl acrylate, ethyl acrylate, n-butyl acrylate, i-butyl acrylate, dodecyl acrylate, n-octyl acrylate, 2-ethylhexyl acrylate, methyl methacrylate, ethyl methacrylate, n-butyl methacrylate, i-butyl methacrylate and dimethylaminoethyl methacrylate; acrylonitriles, such as acrylonitrile and methacrylonitrile; unsaturated dibasic acids or their anhydride, such as maleic acid and maleic anhydride; 2-vinyl pyridine; and mixtures thereof.

When a multifunctional monomer such as divinyl benzene, ethyleneglycol dimethacrylate and trimethylolpropane triacrylate, etc., is added to the above stated monomers as a cross linking agent, the cross linking density of the colored polymer particles will be elevated to yield a toner with improved durability.

For making the polymer particles colored, a coloring agent is associated in polymerization process. The coloring agents are those used for coloring polymer and, for example, carbon black, nigrosine dye, lamp black, aniline blue, chalcoil blue, ultramarine blue, phthalocyanine blue, chrome yellow, quinoline yellow, Du'Pont oil red, rose Bengal, and methylene blue chloride, etc. The coloring agent may be present in an amount of 4 to 20% by weight based on total monomer weight.

Regarding other materials applicable in preparation of the colored polymer particles, commonly used polymerization initiators such as peroxide type and azo type initiators may be exemplified. In addition, mold releasing agents and magnetic materials may be used, if necessary.

In the polymerization process, a dispersing agent may be present for dispersing monomers and other additives in an aqueous medium. The dispersing agent can be anyone known to the art and for example, includes water soluble high molecular compounds such as methylcellulose, carboxymethylcellulose, hydroxyethylcellulose, poly(vinyl alcohol) and gelatin; and water insoluble inorganic powders, such as barium sulfate, calcium sulfate, barium carbonate, magnesium carbonate and calcium phosphate. It is recommended that the dispersing agent is removed by an ordinary washing process after polymerization, because the dispersing agent remaining in an excess will result in an increased amount of organic resin fine particles to be used for conversion into films.

The colored polymer particles in accordance with the present invention have an average particle size of form 2 to 20 μm, preferably from 4 to 12 μm. A particle size less than 2 μm will cause scattering of toner powder while that of beyond 20 μm may deteriorate image quality. It is advantageous that the particle size distribution is narrower. When particles having a particle size of 1 μm or less are abundant, the surface area of the colored polymer particles becomes large, which means an increase of amounts of the charge controlling agent and organic resin fine particles to be used, thus it is not economical. Therefore, it is recommended that by an appropriate operation like centrifugal separation or classification, particles having a particle size of 1 μm or less are removed, if necessary.

Concerning the charge controlling agents used in the present invention, those of commonly known positive or negative charge properties are applicable. As the negative charge controlling agents, there are Spiron-black TRH, T95, and T77 (by Hodogaya Chemical Co., Ltd.), E81 and E84 (by Orient Chemical Industries Inc.), Kayacharge T2 (by Nihon Kayaku Co., Ltd.) and LR120 and LR147 (by Nihon Curite). While as the positive charge controlling agents TP302 (by Hodogaya Chemical Co., Ltd.) and Kayacharge N1 (by Nihon Kayaku Co., Ltd.) may be exemplified.

Preferably the charge controlling agent is used by dissolving or dispersing in aqueous mediums. "Aqueous Medium" means, herein, water or a mixture of water and a water miscible solvent. Examples of the water miscible solvent are alcohols, such as methanol, ethanol, propyl alcohol, and the like; and cellosolves, such as methyl cellosolve, ethyl cellosolve and the like. In order to attain uniform charge properties by small amounts of charge controlling agent, it is desirable that the dispersion of the charge controlling agent is previously treated by means of a ball mill or SG mill, etc., to give a homogeneous and fine state.

The amount of the charge controlling agent to be used in the present invention is preferably within a range from 0.1 to 5% by weight relative to the colored polymer particles, and more preferably from 0.5 to 2% by weight. The amount less than 0.1% by weight will result in unstable electric charge while that of beyond 5% by weight may cause increase in free or liberated charge controlling agent, which impairs not only charge stability with time but also economical production.

In the present invention, the organic resin fine particles may be prepared generally by emulsifying and dispersing a polymerizable monomer in an aqueous medium containing an emulsifier, to conduct emulsion polymerization, because those of favorably particle size are readily produced. The monomers to be formed into the organic resin fine particles are those that are polymerized and, for example, include those listed for the colored polymer particles.

Moreover, organic resin fine particles with improved heat characteristics can be prepared by adding multifunctional monomers such as divinyl benzene, ethyleneglycol dimethacrylate, trimethylolpropane triacrylate and the like, as a cross linking agent, or by adding mercaptans such as octyl thioglycolate and lauryl mercaptan as a chain transfer agent, to the monomer exemplified previously.

With respect to polymerization initiators, water soluble polymerization initiators are commonly used but oil soluble types may be applicable, too. Examples of water soluble polymerization initiators may include persulfates such as potassium persulfate and ammonium persulfate, hydrogen peroxide, 4,4'-azobiscyanovaleric acid, 2,2'-azobis(2-amidinopropane) dihydorchloride, t-butyl hydroperoxide, and cumene hydroperoxide, etc. As oil soluble polymerization initiator there are peroxides such as benzoylperoxide, and t-butylperbenzoate, and azo type compounds such as azobisisobutylnitrile and azobisisobutylvaleronitrile.

As an emulsifier, anionic, cationic, nonionic and amphoteric surfactant may be used in the present invention. Anionic surfactants may include fatty acid salts, such as sodium oleate; salts of alkyl sulfate, such as ammoniumlaurylsulfate; and salts of alkylbenzenesulfonate, such as sodium dodecylbenzenesulfonate. Cationic surfactants may include alkylamine salts, such as laurylamine acetate, and guarternary ammonium salts, such as stearyltrimethylammonium chloride. Concerning nonionic surfactants there are polyoxyethylene alkylether, polyoxyethylene fatty acid ester, sorbitan fatty acid ester and oxyethylene-oxypropylene block polymer, etc. Stearylbetain and the like may be exemplified as an amphoteric surfactant.

The particle size of the organic resin fine particles according to the present invention is preferably ranging from 30 to 500 nm, and more preferably from 80 to 300 nm. Organic resin fine particles having a particle size of less than 30 nm can hardly be produced practically, while those of more than 500 nm can seldom coat the surfaces of the colored polymer particles effectively and are difficult to convert sufficiently into films in the film formation process due to high specific heat. In addition, a glass transition temperature of the organic resin fine particles is preferably within a range from 50° to 80° C. A temperature lower than 50° C. will cause a deterioration of blocking property of the toner, while a temperature higher than 80° C. may cause a fluctuation in charge properties because the resin particles melt not enough to adhere and coat the colored polymer particles in the film conversion process.

The amount of the organic resin fine particles to be used in the present invention is desirably within a range from 2 to 100% by weight based on the colored polymer particles, more desirably from 5 to 40% by weight. The amount less than 2% by weight may result in an insufficient coating of the colored polymer particles, which causes inhomogeneous charge properties or poor improvement in moisture resistance. While the amount beyond 100% by weight will hardly assure the adherence of materially all of the organic resin fine particles to the colored polymer particles by the salting-out so that the liberation of the organic resin particles or aggregation of fine particles occurs readily and thus yielded free organic resin fine particles or aggregates will impair stable charge properties with time.

In the present inventive method, a dispersion mixture is first prepared, containing colored polymer particles, and either an charge controlling agent or organic resin fine particles or the both, in an aqueous medium. The preparation method of the dispersion mixture is not limited particularly but the above stated components must be dispersed homogeneously. If the homogeneous dispersion is not achieved, the adherence of charge controlling agent and the organic resin fine particles to the colored polymer particles is likely to fluctuate. For instance, such method may be applicable that: a homogeneous dispersion, emulsion or solution of each of the colored polymer particles, the charge controlling agent and the organic resin fine particles, in an aqueous medium is separately prepared and then appropriately mixed.

A dispersion of the colored polymer particles in the aqueous medium is prepared, for example, in such a way that the colored polymer particles are fed into an aqueous medium in amounts of 5 to 60% by weight based on the weight of the resulting dispersion and are dispersed homogeneously by stirring by means of a disper or homogenizer. Regarding amounts of the colored polymer particles to be used, that of less than 5% by weight may result in an increase in the amounts to be employed in the salting-out process, while that of more than 60% by weight will cause an inhomogeneous dispersion of the particles.

A dispersion of the charge controlling agent in an aqueous medium is prepared, for instance, by the method of dissolving the charge controlling agent into water miscible medium or by the method of dispersing the charge controlling agent into an aqueous medium followed by pulverization by means of a ball mill or sand grinder mill, etc.

As for the organic resin fine particles, it is recommended to be compounded in the dispersion mixture in the form of an emulsion in an aqueous medium. At this time an emulsion after synthesis may be compounded as it is or it is also possible that treatments for removing impurities like free oligomer, etc., are carried out prior to the incorporation, if necessary.

The incorporation of thus prepared colored polymer particles dispersion, the charge controlling agent dispersion and the organic resin fine particles emulsion is preferably carried out by supplying slowly them with stirring by a disper or a homogenizer without foaming. The incorporation ratios may be determined appropriately depending on the amounts of the constituents among the resulting dispersion mixture and in general 4 to 99% by weight of the colored polymer particles dispersion, 0.01 to 92% by weight of the charge controlling agent dispersion, and 0.1 to 95% by weight of the organic resin fine particles emulsion are advantageous.

Then, to the surfaces of the colored polymer particles, the charge controlling agent and the organic resin fine particles are adhered by salting-out. The salting-out method is not limited particularly and a stepwise process comprising multiple steps may be employed. For example, there are such methods that: (1) the dispersion mixture containing the colored polymer particles, the charge controlling agent and the organic resin fine particles is slowly dropped by a salting-out agent with stirring; (2) to the dispersion mixture containing the colored polymer particles and the charge controlling agent, is added dropwise a part of a salting-out agent with stirring and thereafter the emulsion of the organic resin fine particles is added thereto, followed by adding dropwise the rest of the salting-out agent; (3) to the dispersion mixture containing the colored polymer particles and the organic resin fine particles, is added dropwise a part of the salting-out agent with stirring and thereafter the dispersion of the charge controlling agent is added thereto, followed by adding dropwise the rest of the salting-out agent; and (4) to the dispersion mixture containing the colored polymer particles is added dropwise the salting-out agent and then the dispersion of the charge controlling agent and the emulsion of the organic resin fine particles are dropped thereto simultaneously or separately.

Temperatures of the salting-out process are not limited especially but a temperature range from 5° to 70° C. is desirable. A temperature below 5° C. may be difficult to control practically, while that of beyond 70° C. will cause aggregation of both the colored polymer particles and the organic resin fine particles easily.

The salting-out agents include inorganic acids, such as hydrochloric acid; organic acids, such as formic acid, acetic acid, etc.; water soluble metallic salts, such as salts of the above mentioned acids with alkali metals, alkaline earth metals, aluminum and transition metals, etc.; alkali, such as sodium hydroxide; and amine salts, such as cetyltrimethylammonium chloride, etc. The above stated salting-out agent may be used singly or in combination and the favorable agents are magnesium chloride, calcium chloride, sodium acetate, zinc acetate, copper acetate, ammonium molybdate, ammonium tungstate phosphate, tetramethylammonium chloride, cetyltrimethylammonium chloride, cetylpyridinium chloride and benzyltrimethylammonium chloride, etc., which are used preferably in the form of an aqueous solution.

The amount of the salting-out agent to be used is determined appropriately depending on kinds and amounts of colored polymer particles, charge controlling agent and organic resin fine particles, employed. Smaller amounts of the salting-out agent may result in an insufficient salting-out effect, while an excessive amount will cause not only a deterioration of moisture resistance but also aggregates generation of the resulting toner.

The colored polymer particles, to which the charge controlling agent and the organic resin fine particles are adhered, are prepared by salting-out and dehydrated by means of a centrifugal dehydrator and the like, followed by washing with water 1 to 4 times, if necessary. Because the moisture resistance thereof can be improved by a removal of the excessive salting-out agent. However, the washing must be conducted to such a degree that the charge controlling agent and the organic resin fine particles, which are adhering to the surfaces of the colored polymer particles, may not leave from the polymer particles.

Thereafter the colored polymer particles, to which surfaces charge controlling agent and the organic resin fine particles are adhered, are dried at a temperature from 30 to 50° C. by means of a hot-air drier or a vacuum desiccator. The drying can improve the efficiency of the succeeding step of a mechanical impact loading.

Then by applying a mechanical impact to thus dried colored polymer particles, the organic resin fine particles are respectively converted into a film covering over the each surface of the polymer particles. Apparatuses applying mechanical impact or compression to the colored polymer particles, may include Sample-mill (by Kyoritsu Rikoh), Hybridizer (by Nara Kikai Seisakusho), Ong-mill (by Hosokawa Micron), and Henshell-mixer (by Mitsui-Miike Kakohki), etc., but they are not limited by these examples.

The apparatuses can apply strong impact instantaneously to particles repeatedly in a very short time and convert the organic resin fine particles forcedly into film. More specifically, the apparatus is provided with elements or the like rotatable at a high speed, with which the particles collide to be applied impact and are scattered to collide with the inner wall of the apparatus, i.e., a separately equipped element for impact loading fixedly or rotatably mounted to the apparatus, to be applied impact again. By being applied such a strong impact, the organic resin fine particles adhering to the surfaces of the colored polymer particles are converted into film with containing the charge controlling agent. The apparatus of such a construction can apply a very strong impact repeatedly in a very short time so that films of satisfactory quality can be generated in a very short time. Further heating and the like may be carried out as an auxiliary means.

The impact strength or compression strength applied by the mechanical means must not be so strong as to cause crushing or melt-adhesion of the colored polymer particles produced through the salting-out. On the other hand cares must be taken not to cause a shortage of the impact strength or compression strength in order to prevent the insufficient film formation of the organic resin fine particles.

Thus produced particles can be used as a toner as they are and optionally they may be classified by the commonly known classifier and the like.

EXAMPLES

Figure 1:
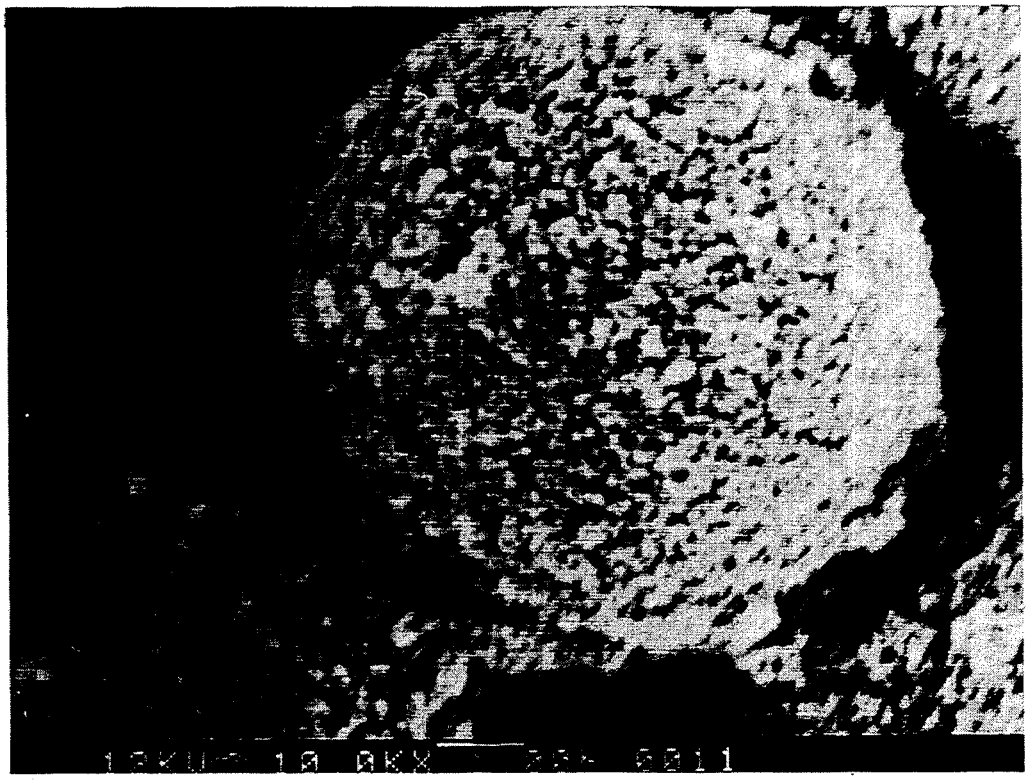
FIG. 1 is a scanning type electron microscopic photograph showing a structure of a colored polymer particle adhered by charge controlling agent and organic resin fine particles, multiplied by 10000.

The present invention will be described in detail below referring to experiments but the scope of the invention is not restricted by them. "Parts" and "%" used herebelow are "parts by weight" and "% by weight" respectively, unless otherwise specified.

Preparation Example 1

Preparation of an aqueous dispersion of colored polymer particles:

400 parts of styrene-n-butyl methacrylate resin "Himer SBM-73F" (by Sanyo Kasei Co., Ltd.) was dissolved in a polymerizable monomer prepared by blending 420 parts of styrene, 175 parts of n-butyl acrylate and 5 parts of ethyleneglycol dimethacrylate. To the resultant mixture, 80 parts of carbon black "Printex 150T" (by Tegsa AG), 30 parts of low molecular weight polypropylene "Biscol 660P" (by Sanyo Kasei) and 30 parts of 2,2'-azobisisobutylonitrile were added and subjected to a sand grinder mill to obtain a carbon black dispersed paste.

Separately a polymer aqueous solution was prepared by mixing 75 parts of "Ghosenol GH-20" (poly(vinyl alcohol) by Japan Synthetic Chemicals; saponification value of 88%), 75 parts of "Ghosenol KL-05" (poly(vinyl alcohol) by Japan Synthetic Chemicals; saponification value of 80%), 15 parts of hydroxypropylcellulose (by Nihon Soda) and 1350 parts of ion exchanged water.

The carbon black dispersed paste previously prepared and the macromolecular aqueous solution were mixed together by means of a planetary mixer to yield a suspension containing oil drops of carbon black dispersion paste.

Thus yielded suspension was diluted with 300 parts of ion exchanged water and kept at 80° C. for 6 hours to conduct a polymerization reaction. Then the resultant was subjected to a solid-liquid separation by means of a centrifugal separator. Thus the aqueous dispersion of the colored polymer particles having an average particle size of 7.8 μm was obtained.

Preparation Example 2

Preparation of an aqueous dispersion of colored polymer particles:

500 parts of styrene, 200 parts of ethylhexyl methacrylate, 100 parts of "Morgal L" (by Cabot) and 50 parts of a pigment dispersing agent obtained by Reference 3 in Japanese Patent Laid-Open No. Hei 3-200976, were blended together and subjected to a sand grinder mill to produce a dispersion paste of carbon black.

Separately, 36 parts of partially saponified poly(vinyl acetate) (available from Kuraray Co., Ltd.) was dissolved in a mixture solvent comprising 945 parts of n-propyl alcohol and 255 parts of ion exchanged water, and heated to 85° C., to which 255 parts of the dispersion paste of carbon black previously produced as above, was fed. Further to the mixture were added 3 parts of benzoylperoxide, 15 parts of "V-40" (1,1'-azobiscyclohexyl-1-carbonitrile, by Wako Junyaku) and a solution comprising 90 parts of styrene and 0.3 parts of divinylbenzene, and the resultant was kept at 85° C. for 16 hours to conduct a polymerization reaction and thereafter was subjected to a solid-liquid separation by means of a centrifugal separator, followed by washing with water. Thus the aqueous dispersion of the colored polymer particles having an average particle size of 6.5 μm was obtained.

Preparation Example 3

Preparation of a charge controlling agent:

A mixture dispersion comprising 30 parts of "T-77" (iron azo dye, by Hodogaya Kagakukogyo) and 970 parts of methanol, was subjected to a sand grinder mill to obtain a partially soluble dispersion of an charge controlling agent in methanol.

Preparation Example 4

Preparation of an charge controlling agent:

50 parts of "LR-147" (boron complex, by Japan Curlit) was dissolved in 950 parts of methanol to obtain a charge controlling agent.

Preparation Example 5

Preparation of a charge controlling agent:

A dispersion comprising 30 parts of "TP-302" (quaternary ammonium salt, by Hodogaya Kagakukogyo) and 970 parts of ethanol was subjected to a sand grinder mill to yield a dispersion of an charge controlling agent in ethanol.

Preparation Example 6

Preparation of an emulsion of organic resin fine particles:

0.1 part of "Cation 300" (alkylenzylammonium salt, by Sanyo Kasei) was dissolved in 390 parts of ion exchanged water and was heated to 80° C. While maintaining at 80° C. the solution was charged with an aqueous solution comprising 1 part of "V-50" (2,2'-azobis-2-amidinopropane dihydrochloride, by Wako Junyaku) and 10 parts of ion exchanged water, and also with a mixture monomer comprising 20 parts of styrene, 40 parts of methyl methacrylate, 15 parts of n-butyl methacrylate and 1 part of octyl thioglycolate, respectively for 60 minutes. 30 minutes later from the termination of the dropping, a monomer mixture was further dropped thereto, comprising 10 parts of styrene, 15 parts of methyl methacrylate and 5 parts of n-butyl methacrylate, for 30 minutes. The resultant mixture was stirred at 80° C. for 2 hours to terminate the polymerization reaction and an emulsion of the organic resin fine particles was obtained.

Preparation Example 7

Preparation of an emulsion of organic resin fine particles:

1 part of "Pellex SS-H" (sodium alkyldiphenylether disulfonate, by Kao) was dissolved in 380 parts of ion exchanged water and heated to 80° C. While maintaining at 80° C., to the solution was dropped an aqueous solution comprising 1 part ammonium persulfate and 8 parts of ion exchanged water and also a monomer mixture comprising 40 parts of styrene, 10 parts of methyl methacrylate, 10 parts of n-butyl methacrylate and 1 part of octylethylhexyl methacrylate and 0.5 parts of octyl thioglycolate, respectively for 90 minutes. 30 minutes later from the termination of the dropping, a monomer mixture was further added thereto, comprising 30 parts of styrene, 5 parts of methyl methacrylate, 5 parts of ethylhexyl methacrylate and 0.5 parts of ethylenecylol dimethacrylate, for 60 minutes. The resultant mixture was stirred at 80° C. for 2 hours to terminate the polymerization reaction and an emulsion of the organic resin fine particles was obtained.

Experiment 1

The aqueous dispersion of the colored polymer particles produced in Preparation Example 1, was adjusted to 20% by weight in concentration using ion exchanged water. With stirring at a room temperature, to 100 parts of thus adjusted aqueous dispersion of the colored polymer particles was added 8 parts of the dispersion prepared in Preparation Example 3, namely, the partially soluble dispersion of "T-77" of 3% by weight, with methanol. To the resultant mixture was dropped 20 parts of an aqueous solution of zinc acetate of 2% by weight for 30 minutes and for further 30 minutes the stirring was continued. Thereafter 20 parts of the emulsion obtained in Preparation Example 7, i.e., the emulsion of the organic resin fine particles, were dropped thereto in the course of 30 minutes, followed by dropping of 10 parts of aqueous solution of zinc acetate of 2% by weight for 10 minutes. After stirring for 30 minutes, the colored polymer particles having thereon the charge controlling agent and the organic resin fine particles, were obtained, of which electron microscopic photograph is shown in FIG. 1.

Figure 2:
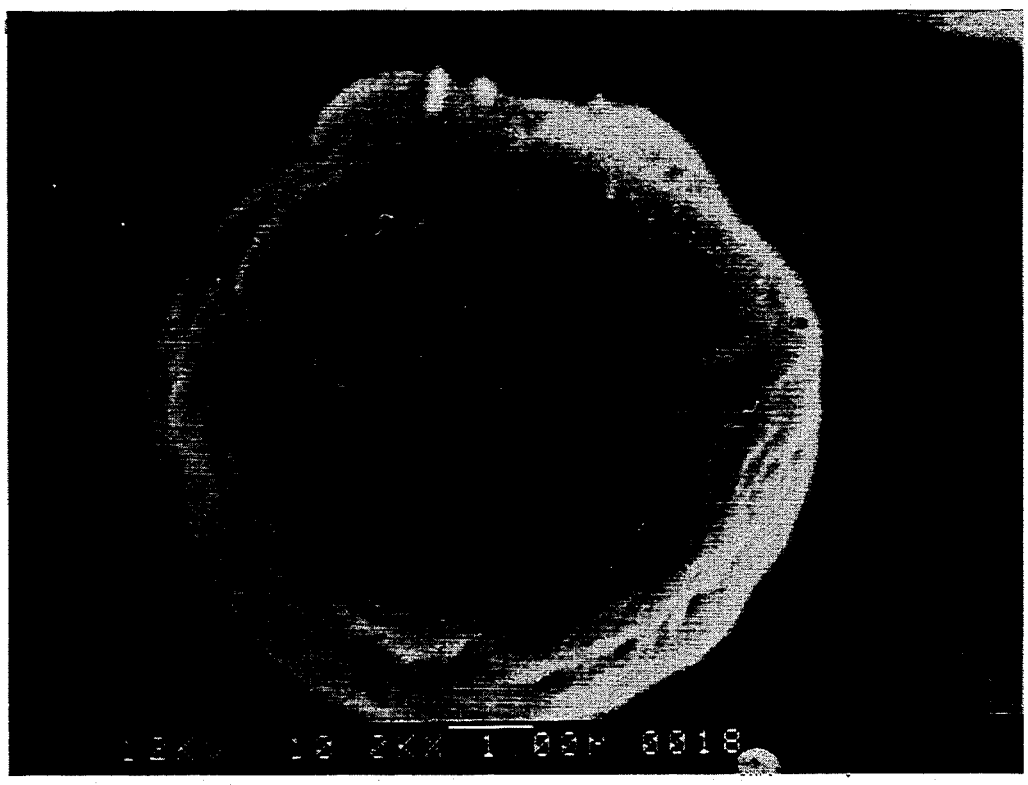
FIG. 2 is a scanning type electron microscopic photograph showing the present inventive structure of a colored polymer particle adhered in its surface by a film which is converted from organic resin fine particles together with charge controlling agent, multiplied by 10000.

Thus produced colored polymer particles adhered by the charge controlling agent and the organic resin fine particles, were subjected to a solid-liquid separation by means of a centrifugal separator an then were dried by a hot-air drier kept at 40° C. To the resultant particles, a mechanical impact using "Sample-mill" (by Kyoritsu Rikoh) was applied to obtain a negative toner in which the colored polymer particles was adhered in its surface by a film which was converted from the organic resin fine particles together with the charge controlling agent. The electron microscopic photograph of thus obtained toner is shown in FIG. 2. Also characteristics of thus obtained toner were evaluated by the following method, the results of which are shown in Table 2.

Volume resistivity

One gram of the toner was pressed at a pressure of 10 ton to prepare a columnar pellet having a radius of 10 mm. Thus prepared pellets were respectively allowed to be left under various environments as shown in Table 1, below. The resultants were respectively measured in terms of volume resistivity under a voltage charge of 1 kV by means of an insulation resistance measuring meter, "Hi-megohm Meter" (by Advantest).

Dielectric loss

One gram of the toner was pressed at a pressure of 10 ton to prepare a columnar pellet having a radius of 10 mm. Thus prepared pellets were respectively allowed to be left under various environments as shown in Table 1, below. The resultants were respectively measured in terms of dielectric loss at 1 kHz frequency by means of an impedance meter, AG-4311 model LCR Meter (by Ando Denki).

Water contact angle

The toner was measured in terms of contact angle relative to water using a wet-tester of WTMY-232A model (by Sankyo Dengyo).

Next, thus produced toner was mixed with silicone coat ferrite carrier in a ratio of 4:96 to prepare a developer I, of which characteristics were evaluated by the following method. The results obtained are shown in Table 3.

Charge amount

The developer I was respectively allowed to be left for 24 hours under various environments as shown in Table 1, below. The resultants were shaked for 5 minutes and were respectively measured in terms of charge amount ($\mu$V/g) by means of a blow-off-powder charge amount measuring apparatus (by Toshiba Chemical).

Charge distribution

The developer I was allowed to be left for 24 hours under MM environments specified in Table 1. The resultant was shaked for 5 minutes and was measured in terms of charge distribution (fC/10 $\mu$m) by means of a charge spectrograph of q-meter horizontal electrode system (by Dr. R. H. Epping).

Charge amount variation

The developer I was allowed to be left for 24 hours under MM condition specified in Table 1. The charge amount of both after 5-minute shaking and after 60-minute shaking were measured and the ratio (%) of the former relative to the latter was calculated.

Image evaluation

An overlapping state was evaluated by naked eyes after 10000-sheet printing by means of modified printer JX-9700 (by Sharp).

TABLE 1

| Environment | Temperature (°C.) | Relative humidity |
|---|---|---|
| LL | 15 | 8 |
| MM | 22 | 55 |
| HH | 35 | 85 |

Experiment 2

The aqueous dispersion of the colored polymer particles produced in Preparation Example 1, was adjusted to 20% by weight in concentration using an ion exchanged water. With stirring at a room temperature, 100 parts of thus adjusted aqueous dispersion of the colored polymer particles were added by 15 parts of an aqueous solution of cetyltrimethylammonium chloride of 1% by weight. Thereafter to the content, 3 parts of the dispersion prepared in Preparation Example 3, namely, the partially soluble dispersion of "T-77" or 3% by weight in methanol, was added slowly for 20 minutes, followed by stirring for 30 minutes. To the resultant mixture was dropped 20 parts of the emulsion of organic resin fine particles produced in Preparation Example 7 for 30 minutes. Further stirring for 30 minutes was carried out and the colored polymer particles adhered by the charge controlling agent and the organic resin fine particles, were obtained.

Thus produced colored polymer particles to which the charge controlling agent and the organic resin fine particles were adhered, were subjected to a solid-liquid separation by means of a centrifugal separator, followed by drying at 40° C. by a hot-air drier. Then the dried particles were applied by a mechanical impact by means of "Sample-mill" (by Kyoritsu Rikoh) to obtain a negative toner in which the colored polymer particles were adhered in its surface by a film which was converted from the organic resin fine particles together with the charge controlling agent. The characteristics of thus obtained toner were evaluated in the same way as in Experiment 1, of which results are shown in Table 2.

Next, the developer II was prepared in the same manner as in Experiment I except that silicone acrylic coat ferrite carrier was employed in place of silicone coat ferrite carrier. Also the characteristics of the developer II were evaluated, of which results are shown in Table 3.

Experiment 3

A negative toner was prepared in the same way as in Experiment 1 except that an aqueous solution of copper acetate of 2% by weight was employed instead of an aqueous solution of zinc acetate of 2% by weight. Characteristics of thus produced toner were also evaluated in the same way as in Experiment 1, of which results are shown in Table 2.

Thus the developer III was prepared in the same manner as in Experiment 1 and the characteristics thereof were evaluated. Results obtained are also shown in Table 3.

Experiment 4

A negative toner was produced in the same manner as in Experiment 1 except that the colored polymer particles prepared in Preparation Example 2 was used in place of polymer particles of Preparation Example 1 of the Experiment 1. Characteristics of thus produced toner were evaluated in the same manner as in Experiment 1, of which results are shown in Table 2.

Thus the developer IV was prepared in the same way as in Experiment 1 and the characteristics thereof were evaluated. Results obtained are also shown in Table 3.

Experiment 5

The aqueous dispersion of the colored polymer particles produced in Preparation Example 1 was adjusted to 20% by weight in concentration using ion exchanged water. With stirring at a room temperature, to 100 parts of thus adjusted aqueous dispersion of the colored polymer particles was added 20 parts of "LR-147" solution of 1% by weight in methanol prepared in Preparation Example 4. To the resultant mixture was dropped 20 parts of an aqueous solution of cetylpyridinium chloride of 1% by weight for 30 minutes, followed by further stirring for 30 minutes. Thereafter 20 parts of the emulsion of the organic resin fine particles produced in Preparation Example to the resultant mixture 7 for 30 minutes, followed by further dropping of 5 parts of aqueous solution of zinc acetate of 2% by weight for 10 minutes. The resultant mixture was stirred for 30 minutes to obtain the colored polymer particles adhered by the charge controlling agent and the organic resin fine particles.

Thus obtained colored polymer particles adhered by the charge controlling agent and the organic resin fine particles, were subjected to a solid-liquid separation by means of a centrifugal separator and were dried by a hot-air drier kept at 40° C. The dried particles were applied by a mechanical impact by means of "Sample-mill" (by Kyoritsu Rikoh) to yield a negative toner in which the colored polymer particles were adhered in its surface by a film which was converted from the organic resin fine particles together with the charge controlling agent. Characteristics of thus obtained toner were evaluated in the same manner as in Experiment 1, of which results are shown in Table 2.

Then the developer V was prepared in the same way as in Experiment 1 except that silicone acrylic coat ferrite carrier was employed instead of silicone coat ferrite carrier. Characteristics of the developer V were evaluated in the same way as in Experiment 1, of which results are shown in Table 3.

Experiment 6

The aqueous dispersion of the colored polymer particles produced in Preparation Example 1 was adjusted to 15% by weight in concentration using ion exchanged water. With stirring at a room temperature, 20 parts of "TP-302" of 3% by weight in ethanol prepared in Preparation Example 5 to 170 parts of thus adjusted aqueous dispersion of the colored polymer particles. Then to the resultant mixture; was dropped 5 parts of an aqueous solution of ammonium molybdate of 1% by weight for 30 minutes, followed by further stirring for 30 minutes. Thereafter to the resultant, 13 parts of the emulsion of the organic resin fine particles produced in Preparation Example 6 was added dropwise for 30 minutes. The resultant mixture was stirred for 30 minutes to give colored polymer particles adhered by the charge controlling agent and the organic resin fine particles.

Thus prepared colored polymer particles to which the charge controlling agent and the organic resin fine particles were adhered, were subjected to a solid-liquid separation by means of a centrifugal separator, and were dried by a hot-air drier kept at 40° C. The dried particles were applied by a mechanical impact by means of "Sample-mill" (by Kyoritsu Rikoh) to yield a positive toner in which the colored polymer particles were adhered in its surface by the film converted from the organic resin fine particles together with the charge controlling agent. Characteristics of thus yielded positive toner were evaluated just in the same manner as in Experiment 1, of which results are shown in Table 2.

Then the developer VI was prepared in the same way as in Experiment 1 and characteristics thereof were also evaluated in the same way as in Experiment 1 except that FT4820 duplicator (by Ricoh) was employed in place of JX-9700 modified printer (by Sharp). The obtained results are shown in Table 3.

Comparative Example 1

The aqueous dispersion of the colored polymer particles produced in Preparation Example 1 was adjusted to 20% by weight in concentration using an ion exchanged water. With stirring at a room temperature, to 100 parts of thus adjusted aqueous dispersion of the colored polymer particles was added 8 parts of the partially soluble dispersion of "T-77" of 3% by weight in methanol, obtained in Preparation Example 3. To the resultant mixture was added dropwise 10 parts of an aqueous solution of zinc acetate of 2% by weight for 30 minutes, followed by stirring for 30 minutes to yield the colored polymer particles adhered by the charge controlling agent.

Thus yielded colored polymer particles adhered by the charge controlling agent, were subjected to a solid-liquid separation by means of a centrifugal separator and were dried at 40° C. by means of a hot-air drier. Then the dried particles were applied by a mechanical impact by means of "Sample-mill" (by Kyoritsu Rikoh) to give a negative toner in which each of the colored polymer particles was adhered in its surface by the charge controlling agent. Characteristics of thus yielded negative toner were evaluated in the same way as in Experiment 1, of which results are shown in Table 2.

Then the developer VII was prepared in the same manner as in Experiment 1 except that silicone acrylic coat ferrite carrier was employed in stead of silicone coat ferrite carrier. Also characteristics of the developer were evaluated, of which results are shown in Table 3.

Comparative Example 2

The aqueous dispersion of the colored polymer particles produced in Preparation Example 1 was adjusted to 20% by weight in concentration using an ion exchanged water. With stirring at a room temperature, to 100 parts of thus adjusted aqueous dispersion was added 20 parts of the emulsion of the organic resin fine particles obtained in Preparation Example 7, and thereafter the resultant was dropped in 15 parts of an aqueous solution of zinc acetate of 2% by weight in the course of 20 minutes. The resultant mixture was stirred for 30 minutes to give the colored polymer particles adhered by the organic resin fine particles.

Thus yielded colored polymer particles adhered by organic fine particles were subjected to a solid-liquid separation by means of a centrifugal separator and were dried by means of a hot-air drier kept at 40° C. Thus dried particles were applied by a mechanical impact using "Sample-mill" (by Kyoritsu Rikoh) to produce a negative toner in which each of the colored polymer particles was adhered in its surface by the film converted from the organic resin fine particles. Characteristics of thus yielded negative toner were evaluated in the same way as in Experiment 1, of which results are shown in Table 2.

Next, the developer VIII was prepared in the same way as in Experiment 1, of which characteristics were evaluated. The results obtained are shown in Table 3.

Comparative Example 3

The aqueous dispersion of the colored polymer particles produced in Preparation Example 1 was adjusted to 15% by weight in concentration using an ion exchanged water. With stirring at a room temperature, to 170 parts of thus adjusted aqueous dispersion was added 13 parts of the emulsion of the organic resin fine particles obtained in Preparation Example 6, and to the resultant was added 5 parts of an aqueous solution of ammonium molybdate of 1% by weight for 30 minutes, followed by stirring for further 30 minutes to give the colored polymer particles adhered by the organic resin fine particles.

Thus yielded particles were subjected to a solid-liquid separation by means of a centrifugal separator and then were dried by a hot-air drier kept at 40° C. Thus dried particles were applied by a mechanical impact using "Sample-mill" (by Kyoritsu Rikoh) to give a positive toner in which each of the colored polymer particles was adhered in its surface by the film converted from the organic resin fine particles. Characteristics of thus yielded positive toner were evaluated in the same manner as in Experiment 1, of which results are shown in Table 2.

Then the developer IX was prepared in the same way as in Experiment 1, of which characteristics were evaluated in the same way as in Experiment 1 except that ET4820 duplicator (by Ricoh) was employed in place of modified printer JX-9700 (by Sharp). The results obtained are shown in Table 3.

What is claimed is:

1. A preparation method of a toner comprising steps of:

(a) preparing a dispersion mixture containing colored polymer particles, a charge controlling agent and organic resin fine particles, in an aqueous medium;

(b) allowing said charge controlling agent and organic resin fine particles to be adhered on the surface of said colored polymer particles by salting-out;

(c) drying said colored polymer particles having thereon said charge controlling agent and organic resin fine particles; and (d) applying mechanical impact to said colored polymer particles to effect a conversion of said organic resin fine particles into a film on the surfaces of said colored polymer particles.

2. A preparation method of a toner comprising steps of:

(a) preparing a dispersion mixture containing colored polymer particles and a charge controlling agent in an aqueous medium;

(b) allowing said charge controlling agent to be adhered on said colored polymer particles by salting-out;

(c) containing organic resin fine particles in the dispersion mixture;

(d) allowing said organic resin fine particles to be adhered on said colored polymer particles by salting-out;

TABLE 2

| | Toner characteristics | Experiment 1 | Experiment 2 | Experiment 3 | Experiment 4 | Experiment 5 | Experiment 6 | Comparative Example 1 | Comparative Example 2 | Comparative Example 3 |
|---|---|---|---|---|---|---|---|---|---|---|
| Volume resistivity | LL environment[a)] | $7 \times 10^{15}$ | $1 \times 10^{16}$ | $8 \times 10^{5}$ | $1 \times 10^{15}$ | $8 \times 10^{15}$ | $6 \times 10^{15}$ | $3 \times 10^{14}$ | $7 \times 10^{14}$ | $1 \times 10^{14}$ |
| | MM environment[b)] | $4 \times 10^{15}$ | $7 \times 10^{15}$ | $4 \times 10^{15}$ | $8 \times 10^{15}$ | $7 \times 10^{15}$ | $3 \times 10^{15}$ | $2 \times 10^{13}$ | $1 \times 10^{14}$ | $6 \times 10^{13}$ |
| | HH environment[c)] | $8 \times 10^{14}$ | $2 \times 10^{15}$ | $5 \times 10^{14}$ | $4 \times 10^{15}$ | $4 \times 10^{14}$ | $2 \times 10^{14}$ | $5 \times 10^{10}$ | $2 \times 10^{11}$ | $7 \times 10^{10}$ |
| Dielectric loss | LL environment | 0.035 | 0.038 | 0.041 | 0.031 | 0.033 | 0.046 | 0.077 | 0.082 | 0.105 |
| | MM environment | 0.033 | 0.033 | 0.034 | 0.030 | 0.030 | 0.040 | 0.065 | 0.094 | 0.088 |
| | HH environment | 0.038 | 0.040 | 0.046 | 0.040 | 0.036 | 0.055 | 0.217 | 0.348 | 0.525 |
| Angle of contact with water | | 125° | 126° | 125° | 127° | 125° | 123° | 102° | 118° | 113° |

[a)] 15° C., relative humidity 8%
[b)] 22° C., relative humidity 55%
[c)] 35° C., relative humidity 85%

TABLE 3

| Developer characteristics | | Developer I Experiment 1 | Developer II Experiment 2 | Developer III Experiment 3 | Developer IV Experiment 4 | Developer V Experiment 5 | Developer VI Experiment 6 | Developer VII Comparative Example 1 | Developer VIII Comparative Example 2 | Developer IX Comparative Example 3 |
|---|---|---|---|---|---|---|---|---|---|---|
| Carrier | | Carrier A[1)] | Carrier B[2)] | Carrier A | Carrier A | Carrier B | Carrier A | Carrier B | Carrier A | Carrier A |
| Charge amount | LL environment[a)] | −32 | −18 | −30 | −43 | −15 | +23 | −17 | −31 | +25 |
| | MM environment[b)] | −31 | −18 | −27 | −41 | −13 | +20 | −18 | −25 | +20 |
| | HH environment[c)] | −28 | −15 | −23 | −36 | −10 | +17 | −14 | −8 | +12 |
| Charge distribution | Average electrified quantity | −8.6 | −4.8 | −9.1 | −10.3 | −3.6 | +7.1 | −3.3 | −8.4 | +7.5 |
| | Standard deviation | 2.6 | 1.7 | 3.8 | 3.5 | 1.5 | 2.5 | 1.0 | 5.9 | 4.1 |
| | Reverse polarity (%) | 1 | 3 | 3 | 1 | 4 | 1 | 7 | 34 | 26 |
| Charge amount variation (%) | | 93 | 95 | 117 | 84 | 98 | 105 | 47 | 78 | 85 |
| Image evaluation | | Satisfactory | Satisfactory | Satisfactory | Satisfactory | Satisfactory | Satisfactory | fogging occurred | fogging occurred | fogging occurred |

[1)] Silicone coat ferrite carrier
[2)] Silicone acrylic coat ferrite carrier
[3)] 15° C., relative humidity 8%
[4)] 22° C., relative humidity 55%
[5)] 35° C., relative humidity 85%

(e) drying said colored polymer particles having thereon said charge controlling agent and organic resin fine particles; and (f) applying mechanical impact to said colored polymer particles to effect a conversion of said organic resin fine particles into a film on the surfaces of said colored polymer particles.

3. A preparation method of a toner comprising steps of:

(a) preparing a dispersion mixture containing colored polymer particles and organic resin fine particles in an aqueous medium;

(b) allowing said organic resin fine particles to be adhered on said colored polymer particles by salting-out;

(c) containing a charge controlling agent in the dispersion mixture;

(d) allowing said charge controlling agent to be adhered on said colored polymer particles by salting-out;

(e) drying said colored polymer particles having thereon said charge controlling agent and organic resin fine particles; and (f) applying mechanical impact to said colored polymer particles to effect a conversion of said organic resin fine particles into a film on the surfaces of said colored polymer particles.

4. A preparation method of a toner according to any of claims 1 to 3, wherein said colored polymer particles have an average particle size of from 2 to 20 μm, and said organic resin fine particles have an average particle size of from 30 to 500 nm and further said salting-out process is conducted using an aqueous solution containing one or more metal salts or amine salts.

5. A preparation method of a toner according to any of claims 1 to 3, wherein said colored polymer particles are prepared by a suspension polymerization while said organic resin fine particles are prepared by an emulsion polymerization.

* * * * *